US005098140A

United States Patent [19]

Kentner

[11] Patent Number: 5,098,140

[45] Date of Patent: Mar. 24, 1992

[54] GATE CLOSER

[76] Inventor: Lester J. Kentner, 62875 Johnson Ranch Mkt. Rd., Bend, Oreg. 97701

[21] Appl. No.: 694,917

[22] Filed: May 2, 1991

[51] Int. Cl.[5] ..... E06B 3/80

[52] U.S. Cl. ..... 292/247; 292/205

[58] Field of Search ..... 242/113, 247, 104, 205

[56] References Cited

U.S. PATENT DOCUMENTS

| | | | |
|---|---|---|---|
| 754,357 | 3/1904 | Spencer | 292/247 |
| 1,392,934 | 10/1921 | Glandt | 292/247 |
| 1,570,734 | 1/1926 | Eversman | 292/247 |
| 2,973,595 | 3/1961 | Lamphier | 292/247 X |
| 3,825,053 | 7/1974 | Romberg | 292/247 X |

*Primary Examiner*—Richard E. Moore
*Attorney, Agent, or Firm*—Robert L. Harrington

[57] ABSTRACT

A closer mechanism for a flexible gate is disclosed. The mechanism is mountable to a member at one end of the gate opening. A bail for receiving the upper end of a gate post is moveable toward and away from the stationary member by the pivoting motion of an operating lever. The mechanism provides a mechanical advantage to provide a force to tension the gate as it is closed. The mechanism has adjustable features for mounting the mechanism and adjusting the distance the bail is moved as the lever is pivoted. A lower loop is provided for receiving the lower end of the gate post.

6 Claims, 2 Drawing Sheets

GATE CLOSER

BACKGROUND INFORMATION

1. Field of the Invention:

This invention relates to wire fencing and in particular it relates to a mechanism for securing a flexible gate in a closed position.

2. Background Information:

Fences constructed from wire are placed under tension to maintain the wires in position. This applies to fences constructed of stranded wire, such as barbed wire, woven wire and combinations of woven wire and stranded wire. Without tension, the fence would not effectively provide a barrier to prevent intrusion or escapement. Fences are often used to confine animals, such as livestock within a confined area.

Gates provide doorways through the fences. The gates are generally constructed of the same material as the fence. That is a barbed wire fence will have a barbed wire gate and a woven wire fence will have a woven wire gate. This provides for unity of construction and provides the same barrier as the fence. The gates will vary in width depending on the need. A simple walk gate may be on the order of three feet and a gate spanning a roadway may exceed twenty feet. The gate has an end post and depending on the length of the span may have multiple support posts placed at intervals along the span. The gate posts are not secured to the ground and rely on the wire tension to maintain them in a vertical position.

It has always been a problem to tension the gate. A gate requires the same tension as the fence to provide the same protective barrier. Users also desire the same tension for aesthetic appeal.

A post is provided in the fence at each end of the opening that the gate is to span. Typically, one end of the gate is fixedly fastened to one gate post, which we will refer to as a hinge post, and is removably fastened to the other gate post, which we will refer to as a latch post, by various fastening methods. Typical removable fastening methods include a loop placed near the lower end of the latch post with another loop placed on the latch post at an elevation to engage the end post of the gate.

The gate is closed by inserting the bottom of the end post into the lower loop. The end post is generally tilted with reference to the latch post to relieve the tension and permit easy insertion of the lower end of the end post into the lower loop. The top of the end post is then forced toward the latch post and the upper loop is placed over the end post of the gate. For a gate of any span, this requires a great deal of force to place the wire gate under tension.

Gates are also utilized to span openings other than that of fences. For example, a rancher may utilize a gate to span a doorway of a pole barn during the warm months of the year.

BRIEF SUMMARY OF THE INVENTION

The present invention is a closing mechanism for selectively tightening and loosening a flexible gate of a fence or other structure as generally described above. The gate, in order to provide the same barrier as the fence proper must be closed in a similar tensioned condition as the fence. The closing mechanism has a mechanical advantage to provide the force necessary to tighten or tension the gate. An operating lever is pivotally mounted to a latch post of the fence. A bail for receiving an upper end of an end post of the gate is in turn pivotally mounted to the lever at a distance from the pivotal axis of the lever. As the lever is pivoted, the bail is either moved toward or away from the latch post depending on the direction of pivot of the lever. A gate end post received in the bail is thus moved either toward or away from the latch post. Movement toward the latch post causes a tightening of the gate and movement away from the latch post loosens the gate. The mechanical advantage is provided by the difference in the length of the lever arm pivoting the lever versus the length of the lever arm moving the bail.

The throw of the mechanism is adjustable, that is the distance the bail is moved as the lever is pivoted may be adjusted to suit the need.

A locking mechanism is provided for security.

DESCRIPTION OF THE PREFERRED EMBODIMENT

Wire gates, to be effectively closed and to provide the same barrier as the wire fence must be tensioned. Closing the gate under tension requires a large force. The present invention provides a closer for a gate that provides a user the mechanical advantage to effectively close the gate under tension.

Figure 1:
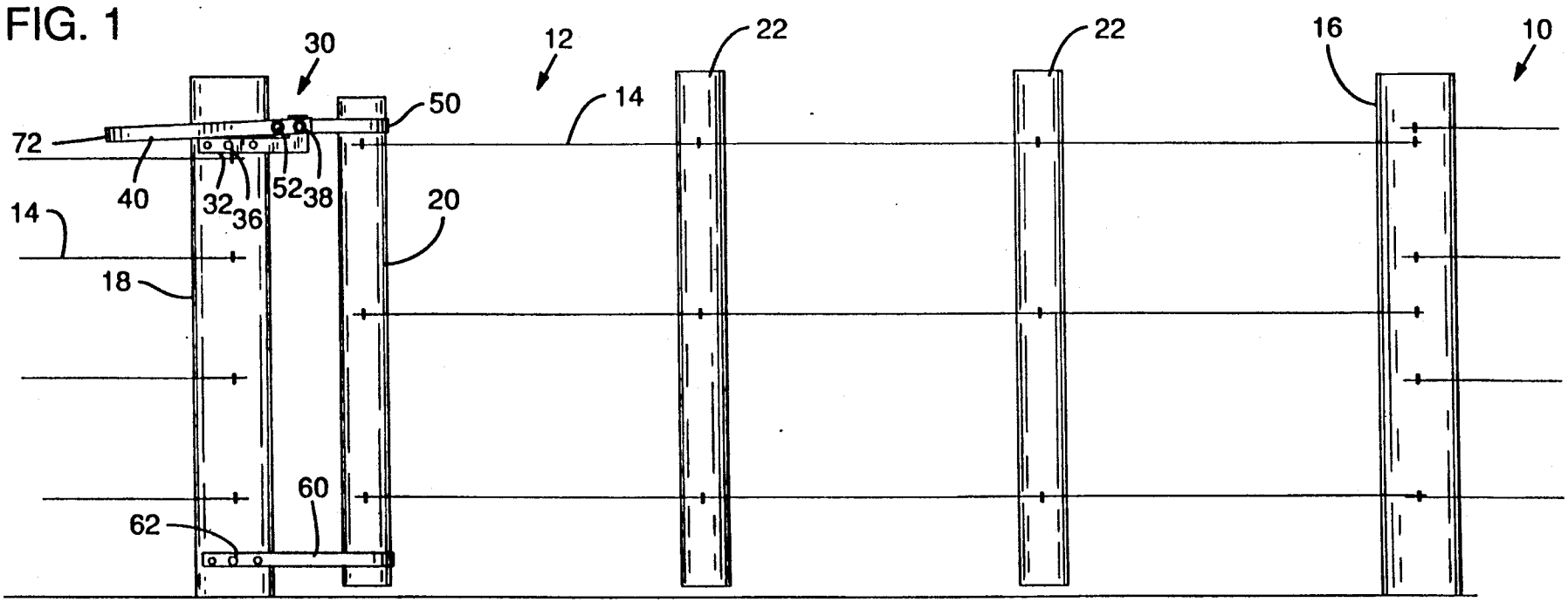
FIG. 1 is a view of a fence and a gate with a gate closer of the present invention.

Refer now to FIG. 1 of the drawings which illustrates a fence 10 having a flexible gate 12. The gate 12 is openable to provide an opening through the fence 10 and is closeable to provide a barrier for a span that reaches from a hinge post 16 to a latch post 18. The fence 10 and gate 12 illustrated in FIG. 1 are of the multiple strand type having wires 14, but the fence may be of any of the common wire constructions such as barbed, woven, combination of barbed and woven, square mesh, chicken wire and other types or combinations as required by a user. The gate 12 is usually of the same construction as the fence 10 but it may be of other combinations also. The gate 12, regardless of the type provides an opening for passage through the fence, i.e. between posts 16, 18. The gate 12 is of course openable to provide passage and closeable to provide the same barrier as the fence 10. In order to provide the same barrier as the fence 10, it is preferable to close the gate 12 of the fence in the same tensioned manner as the fence 10. The present invention is a closer to accomplish this task.

The wires 14 of the gate 12 are affixed to the hinge post 16 (i.e., one end of the opening that the gate spans) as by stapling or other types of fastening in a conventional manner. The wires 14 are of a length to extend from the hinge post 16 to the gate end post 20 and are attached to the gate end post 20 as by stapling. As shown in FIG. vertical riser posts 22 are positioned at intervals along the length of the gate !2 in a spaced relation and are affixed to the wires 14 as by stapling. The gate 12 in FIG. 1 is shown in the closed position.

Figure 2:
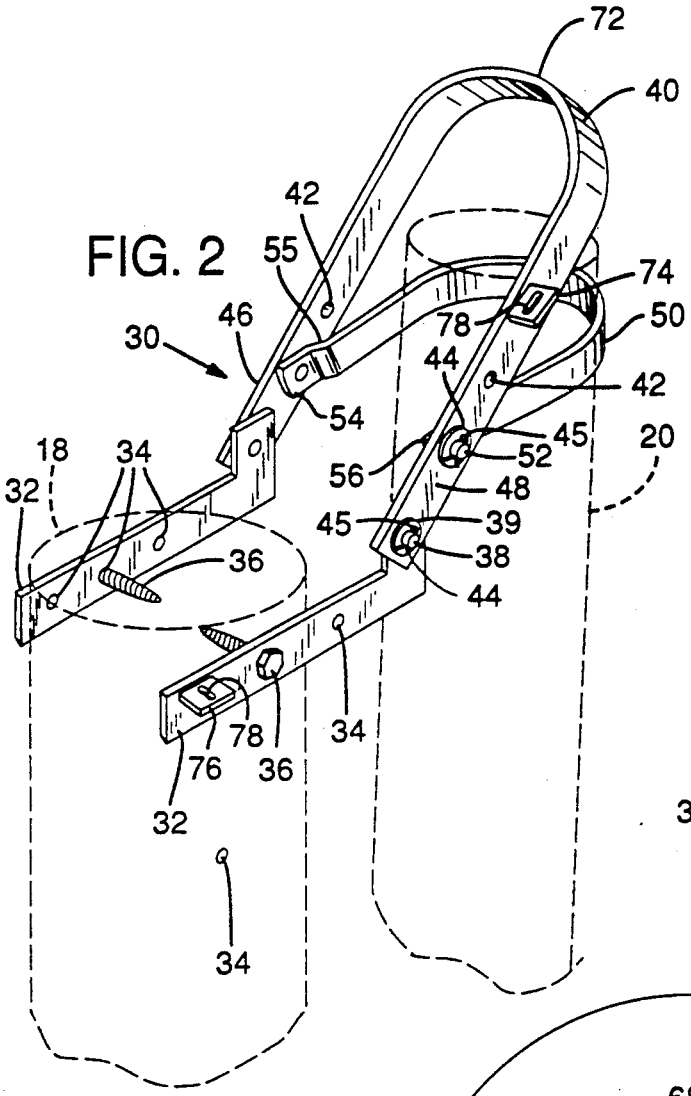
FIG. 2 is a view of the gate closer of the present invention installed on a latch post of a fence.

Refer now to FIG. 2 of the drawings which illustrates the closer mechanism 30, which is preferably fabricated from mild steel. The closer mechanism 30 has an "L" shaped anchor strap 32 having multiple spaced bores 34 provided in one leg of the "L" as shown. As shown, two anchor straps 32 are affixed to a latch post 18 (i.e., one end of the opening that the gate spans), one on either side of the post. The opposed straps 32 are placed in alignment and attached by fasteners 36, such as a lag screws inserted through the bores 34 and threadably installed in the latch post 18. The multiple bores 34 are provided to accommodate different sizes of posts and also to allow discriminate positioning of the anchor strap 32 in reference to the post 18. A stud 38 is provided on the other leg of the "L" on each of the anchor straps 32. The studs 38 are affixed to the anchor strap 32 as by welding and as shown are normal to the surface of the anchor strap 32 and have a cross bore 39 (not shown) for receiving a cotter pin in a conventional manner. The anchor straps 32 are preferably installed to the latch post 18 with the studs 38 in axial alignment.

A lever 40, preferably in the shape of a "U", has multiple spaced bores 42 in each of its legs 46, 48 with one bore near the end of leg 46 and a corresponding bore near the end of leg 48. The bores 42 near the ends of legs 46, 48 of the lever 40 are aligned with and fitted to the studs 38 of the anchor straps 32. The lever 40 is pivotally mounted to the anchor straps 32 with leg 46 being pivotally mounted to one anchor strap 32 and leg 48 being pivotally mounted to the other anchor strap 32. The lever 40 is secured to the studs 38 of the anchor straps 32 by a washer 44 and cotter pin 45 fitted in the cross bore 39 in the stud 38 in a conventional manner.

A bail 50, preferably "U" shaped similar to lever 40, having studs 52 fitted adjacent its ends 54 and 56 is pivotally attached to the lever 40. The studs 52 are affixed to the bail 50 as by welding and as shown are normal to the surface of the bail 50 and have a cross bore 39 for receiving a cotter pin in a conventional manner. The bail 50 has an offset bend 55 near end 54 and an offset bend 57 near end 56. The stud 52 adjacent end 54 of the bail 50 is aligned with and installed in a bore 42 in the leg 46 of the lever 40 and the stud 52 adjacent end 56 is aligned with and installed in a corresponding bore 42 in the leg 48. The bail 50 is thus pivotally attached to the lever 40 by the studs 52 fitting in the aligned bores 42 of the legs 46, 48 of the lever 40. The studs 52 are secured in the bores 42 as by washers 44 and cotter pins 45 fitted in the cross bores 39 in a conventional manner.

The lever 40 is thus pivotally mounted to the anchors 32 and the bail 50 is pivotally mounted to the lever 40. The lever 40 and the bail 50 may be pivoted independent of each other.

Note that although studs have been described and illustrated for pivotally mounting the lever 40 to the anchor straps 32 and the bail 50 to the lever 40, other conventional fastening members may be utilized as for example bolts and nuts.

The axis of the aligned studs 38 is the pivotal axis of the lever 40 and the axis of the aligned studs 52 is the pivotal axis of the bail 50.

Figure 3:
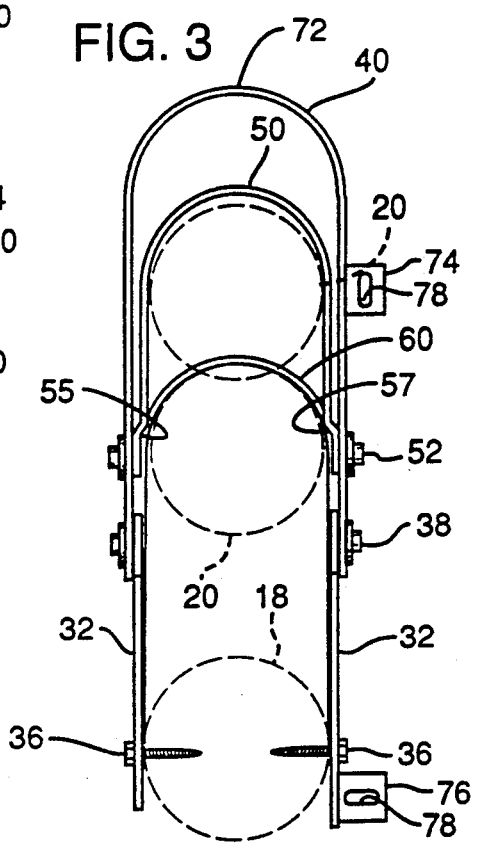
FIG. 3 is a top view of the gate closer of FIG. 2.
Figure 4:
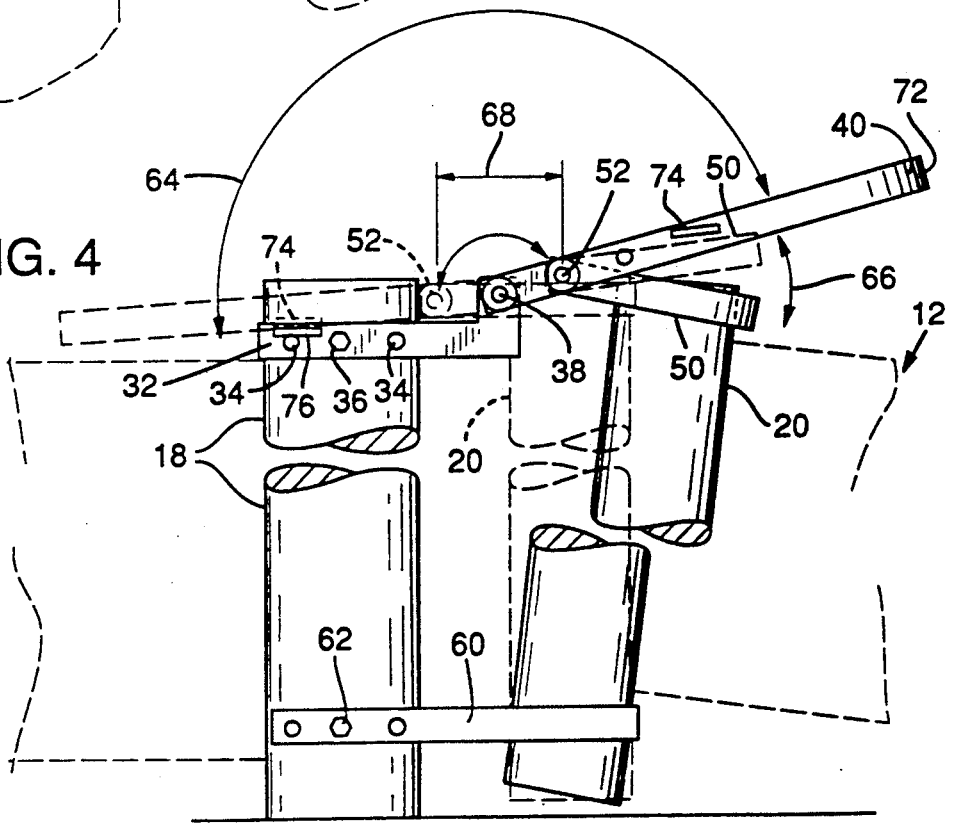
FIG. 4 is another view of the gate closer of the present invention shown in the open and closed positions.

Refer now also to FIGS. 3 and 4 of the drawings. FIG. 4 shows the anchor straps 32 secured to the top of a latch post 18, the anchor straps 32 being mounted to the latch post at height corresponding to the height of the gate 12 so that a top portion (end) of the gate end post 20 may be received in the bail 50. A "U" shaped strap 60 is mounted near the ground on the latch post 18 by fasteners 62, such as lag bolts. The strap 60 is for receiving the lower portion (end) of the gate end post 20.

As seen in FIG. 3 the closer mechanism is shown in the "open" position with the upper portion of the end gate post 20 received in the bail 50 and the lower portion of the end gate post 20 received in the "U" shaped strap 60. For clarity of the drawing, the end gate post is shown in phantom lines.

FIG. 4 illustrates the closer mechanism 30 in both the open and closed positions, with the mechanism 30 shown in solid lines in the open position and shown in dashed lines in the closed position. As best seen in FIG. 4 the lever 40 is pivotable relative to the anchor straps 32 as indicated by the bi-directional arrow 64. The bail 50 is pivotable relative to the lever 40 as indicated by the bi-directional arrow 66. The arc length of the directional arrows 64, 66 are not indicative of the degree of pivot but only indicate the direction of the pivotal motion capability.

FIG. 4 also shows the blocks affixed to the lever 40 and anchor strap 32. Block 74 is fixedly attached to the lever 40 and the block 76 is fixedly attached to the anchor 32 as by welding. The blocks 74, 76 are positioned adjacent each other when the mechanism 30 is in the closed position. Each block 74, 76 has an elongate slot 78 and as shown the slot 78 in block 74 is positioned transverse to the slot 78 in block 76. The slots 78 in blocks 74, 76 will cooperatively receive a locking mechanism, such as a padlock (not shown) to secure the locking mechanism in the closed position. The transverse positioning of the slots 78 permits insertion of a lock mechanism even during misalignment.

The mechanism 30 provides a user with a mechanical advantage to close the gate tightly in a tensioned condition. As seen in FIG. 4, the distance from the handle end 72 to the axis of pivot of the lever 40 (i.e. the studs 38) is greater than the distance from the pivotal mounting of the bail 50 to the axis of pivot of the lever (i.e. the studs 52).

OPERATION

With reference to FIG. 4., the closer 30 is operable by pivoting the lever 40 on the studs 38 of the anchors 32.

To close, i.e. tighten, the gate 12, the lever 40 is first pivoted to the right (as viewed in FIG. 4) to thus move the mechanism 30 to the open position. The lower end of the gate end post 20 is placed in the "U" shaped strap 60 and the bail 50 is positioned over the upper end of the gate end post 20. This is the condition as shown by the solid lines in FIG. 4. The lever 40 is then pivoted to the left (as viewed in the figure), which forces the upper end of the gate end post received in the bail 50 to be moved toward the latch post 18. As the gate end post is moved toward the latch post 18, the wires 14 of the gate are tensioned. The distance moved is indicated by the distance arrow 68, which represents the throw of the mechanism 30. (The throw of the mechanism 30 may be changed by changing the pivotal mounting position of the bail 50 with reference to the lever 40).

As seen in FIG. 4, the pivot axis of the bail 50 goes over center as the lever 40 is pivoted to the closed position. As viewed in the figure, any force that urges the post 20 received in the bail 50 away from the post 18 will force the lever 40 to pivot downward. As shown the pivotal axis of the bail 50 is below the pivotal axis of the lever 40 when in the closed position. Thus a force, such as caused by the tensioned gate is directed in a line from the bail connections to the engagement of the bail loop with the gate end post and is below the pivotal axis of the lever 40.

To open the gate 12, i.e. loosen, the lever 40 is pivoted to the right (again as viewed in FIG. 4) which moves the bail 50 to the right and allows the upper end of the gate post received in the bail to move away from the latch post 18.

Those skilled in the art will recognize that variations and modifications may be made without departing from the true spirit and scope of the invention. The invention is therefore not limited to the illustrated and described embodiments but is to be determined by the appended claims.

What is claimed is:

1. A closer mechanism for a flexible gate having a gate end post to be secured to a stationary member defining one end of an opening to be closed by the flexible gate, said closer mechanism comprising:

a bail for receiving the upper end of the gate end post;

a pair of rigid L shaped straps having a first leg and a second leg, an end of the first leg attached to the stationary member and an opposite end of the first leg extending toward the opening, the second leg extending upward from the opposite end of said first leg;

a lever forming a loop having its two ends pivotally attached to the upwardly extended second legs of the L shaped straps for pivotal movement of the lever between a first position and a second position;

said bail forming a loop for encircling the gate end post and having its ends pivotally attached to the lever inwardly of the pivotal connections thereof to the L shaped straps for movement of said bail as said lever is pivoted between the first and second positions, said lever having its first position with the loop of the lever pivoted into the opening and its second position with the loop of the lever pivoted to surround the stationary member whereby as the lever is pivoted between the first and second positions, the bail and gate end post received in the bail are drawn from a position spaced from said stationary member to a position closer to said stationary member to thereby tension the gate.

2. A closer mechanism as defined in claim 1 wherein a closed loop strap is attached to the stationary member for receiving the lower end of the gate post.

3. A closer mechanism as defined in claim 1 wherein the pivoting of the lever causes pivoting of the pivotal connection of the bail, said pivoting of the bail causing the gate end post received in the bail to move toward the stationary member creating increased tension resulting in a force, the force being directed in a line from the bail connections to the engagement of the bail loop with the gate end post, said connections of the lever on the second legs of the straps being positioned above the line of force when closed whereby said force urges the lever to pivot downwardly and thereby maintain the closed position of the closer mechanism.

4. A closer mechanism as defined in claim 3 wherein length adjusting means are provided to adjust the length of the straps extended toward said opening.

5. A closer mechanism as defined in claim 4 wherein adjusting means are provided to adjust the position of the bail connections relative to the ends of the lever.

6. A closer mechanism as defined in claim 1 wherein locking means are provided to lock the lever in the second position.

* * * * *